US008714554B2

(12) United States Patent
Chu

(10) Patent No.: US 8,714,554 B2
(45) Date of Patent: May 6, 2014

(54) MULTIFUNCTIONAL SHOOTING TARGET STRUCTURE

(75) Inventor: Jerry Chu, Taipei Hsien (TW)

(73) Assignee: Viper Target Co., Ltd., New Taipei (TW)

( * ) Notice: Subject to any disclaimer, the term of this patent is extended or adjusted under 35 U.S.C. 154(b) by 296 days.

(21) Appl. No.: 13/354,105

(22) Filed: Jan. 19, 2012

(65) Prior Publication Data

US 2013/0087974 A1 Apr. 11, 2013

(30) Foreign Application Priority Data

Oct. 11, 2011 (TW) ..... 100218994 U

(51) Int. Cl.
*F41J 13/02* (2009.01)
*F41J 3/00* (2006.01)

(52) U.S. Cl.
USPC ..... 273/404; 273/403; 273/407

(58) Field of Classification Search
USPC ..... 273/403–410, 348
See application file for complete search history.

(56) References Cited

U.S. PATENT DOCUMENTS 570,820 A * 11/1896 Scratton ..... 273/404
883,077 A * 3/1908 Baker ..... 273/404
937,733 A * 10/1909 Worrell ..... 273/404
1,886,562 A * 11/1932 Lefever ..... 273/382
2,039,352 A * 5/1936 Ross ..... 273/407
2,535,280 A * 12/1950 Gartrell ..... 273/404
2,743,106 A * 4/1956 Schels ..... 273/394
3,319,960 A * 5/1967 Wilcox ..... 273/404
3,495,829 A * 2/1970 Booth ..... 273/371
3,899,175 A * 8/1975 Loe ..... 273/378
4,470,604 A * 9/1984 Hoffmann ..... 273/404
4,583,744 A * 4/1986 Tolliver et al. ..... 273/404
5,618,044 A * 4/1997 Bateman ..... 273/410
2010/0090407 A1* 4/2010 Lin ..... 273/371
2011/0062667 A1* 3/2011 Medina et al. ..... 273/404
2011/0187053 A1* 8/2011 Mayorkis et al. ..... 273/408
2011/0233870 A1* 9/2011 Oh et al. ..... 273/410
2012/0049459 A1* 3/2012 Byram et al. ..... 273/407
2013/0187336 A1* 7/2013 Dreiband ..... 273/410

* cited by examiner

*Primary Examiner* — Mark Graham

(57) ABSTRACT

A multi-purpose shooting target includes a target box with an inner space, a deceleration projectile stopping device and a double-faced target plate. A projectile collecting groove is disposed in the inner space at the lower side of the target box, and the double-faced target plate provides a combined blowgun/darts target plate. After a projectile pierces a target sheet, the momentum of the projectile is absorbed by the deceleration projectile stopping device. Finally, the projectile drops into the projectile collecting groove, providing highly efficient stopping and collecting of projectiles. A user can enjoy shooting safely, while avoiding risks associated with ricocheting projectiles. Since the face of the double-faced target plate can be changed quickly, it can be used as a shooting target structure for a toy gun, a blowgun target and a dartboard, allowing a shooting activity that is both safer, more diversified and amusing.

15 Claims, 5 Drawing Sheets

MULTIFUNCTIONAL SHOOTING TARGET STRUCTURE

BACKGROUND OF THE INVENTION

1. Field of the Invention

The present invention relates to a three-in-one indoor and outdoor shooting target, and more particularly to a multifunctional shooting target that combines together a toy gun target, a blowgun target and a dartboard. Various embodiments provide a diversity of amusement, convenience, environmental protection and safety. A user can enjoy the trouble-free amusement of indoor and outdoor shooting sports through the use of the present invention.

2. Background

The sport of shooting is a leisurely activity, which provides relaxation for the body and mind, relieving stress and providing a sporting effect. However, conventional shooting targets are almost always a single target without any subordinate function; this limitation and insufficiency exists in a single function, and worse, may lead to accidental injuries from ricocheting projectiles (such as BBs).

As far as toy guns go, some users use a cardboard box filled with cloth as a homemade target. Though the shooting area of the target is wide, the volume thereof is large too; it is not convenient to carry, and projectiles (i.e., BBs) stuck in the cloth filling cannot drop such that collection of the projectiles is difficult. In addition, a projectile shot later may collide with embedded projectiles fired earlier, ricocheting or shattering before exiting the target box, which is a source of danger; the more ricochets there are, the greater the damage caused to the target paper and the greater the chance of accidents. Furthermore, a large number of ricochets are inconvenient for cleaning purposes. Moreover, the environmental hazard of ricochets extends to both indoor and outdoor shooting activities, if aluminum cans or homemade cardboard boxes are used as targets.

The effective shooting area of current common toy gun targets are too small, causing new users to be afraid of or worried about projectiles that miss the target, hit walls and ricochet to hit the new users themselves. Furthermore, the target is provided with only one single projectile blocking device, which is incapable of stopping projectiles precisely and dropping them into a projectile collecting space so that these kinds of targets are only suitable for single-shot-type low shooting speed toy guns. However, many current toy guns are provided with a fast repeating action and high projectile velocities. If a high-velocity full-automatic toy gun is employed, impact forces and mutual collisions of projectiles on a shooting plane increases rapidly, and the number and speed of ricochets out of the target space also increases. In view of this, the projectile blocking, stopping and collecting effects of a target need to be improved to allow a shooter not to worry about practicing a shooting sport.

As far as both blowgun shooting and dart throwing goes, blowgun shooting is usually performed outdoors and uses trees as targets, causing plants to be damaged, since there is currently a lack of outdoor blowgun-dedicated targets, and no suitable indoor targets for practice are available. Vice versa, dart throwing is always performed indoors with a hanging dartboard, and currently, since there is a lack of outdoor dartboards that can stand stably and withstand the forward flying impact generated from a dart after being thrown, the challenge and pleasure brought from dart throwing is limited to the indoors.

SUMMARY OF THE INVENTION

To improve the defects of the conventional structures mentioned above, the present invention is proposed.

A main objective of the present invention is to provide a three-in-one indoor and outdoor shooting target, being conveniently portable for a user, allowing the user to enjoy securely and confidently the challenge and amusement yielded from multiple shooting activities at the same time regardless of whether it is installed indoors or outdoors, while avoiding polluting of the environment.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1:
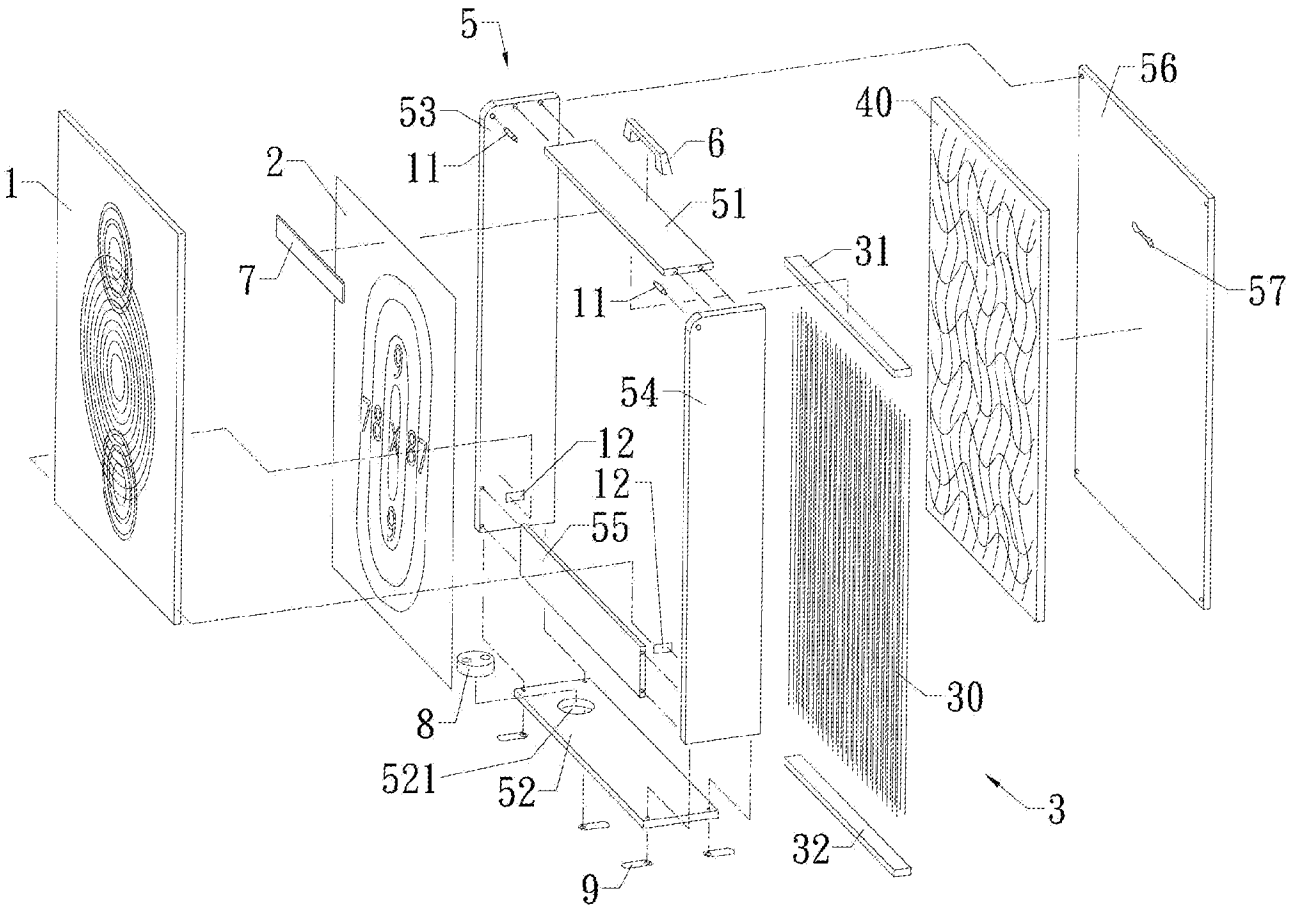
FIG. 1 is an exploded view of an embodiment shooting target of the present invention.

First, referring to FIGS. 1 to 4, a three-in-one indoor and outdoor shooting target provides a shooting target structure that combines together the three targets of a toy gun target, a blowgun target and a dartboard; it includes a double-faced target plate 1, a deceleration projectile-stopping device 3 and a target box 5.

The double-faced target plate 1 is a combined double target plate that provides a blowgun target and a dartboard respectively disposed on the front and rear faces thereof, allowing it to be used as a shooting target for both blowguns and darts; the lower side of the double-faced shooting target 1 is coupled to a lower target-plate fixing elements 12, allowing the double-faced target plate 1 to take a straight line passing through the two lower target-plate fixing elements 12 respectively disposed on two sides thereof as a rotating axis to be rotated through 180 degrees.

The deceleration projectile-stopping device 3 is a deceleration strip set 30 constituted by a plurality of strips arranged vertically, for example; a strip set fixing element 31 and a strip set fixing element 32 are respectively disposed on the upper side and the lower side thereof. The deceleration projectile-stopping device 3 may also be an impact absorber 40, or constituted by the impact absorber 40 and the deceleration strip set 30 used for operating in coordination with each other.

The target box 5 is constituted by an upper panel 51, lower panel 52, left panel 53, and right panel 54. The target box 5 further includes projectile collecting groove panel 55 and rear panel 56, and an inner space is formed among them, where the deceleration projectile-stopping device 3 can be accepted in the inner space 50 by the upper strip-set fixing element 31 of the deceleration projectile-stopping device 3, and coupled to the upper panel 51 at the upper inner side of the target box 5. Furthermore, a hanging hole 57 is used for hanging on a wall surface, and a convenient portable handle 6 is disposed on the upper side of the upper panel 51. In addition, a target sheet clip 7 for locking a target sheet 2 is disposed on the front side of the upper panel 51, and a projectile collecting groove 58 is formed by surrounding the projectile collecting groove panel 55 on the lower side of the target box 5.

Figure 2:
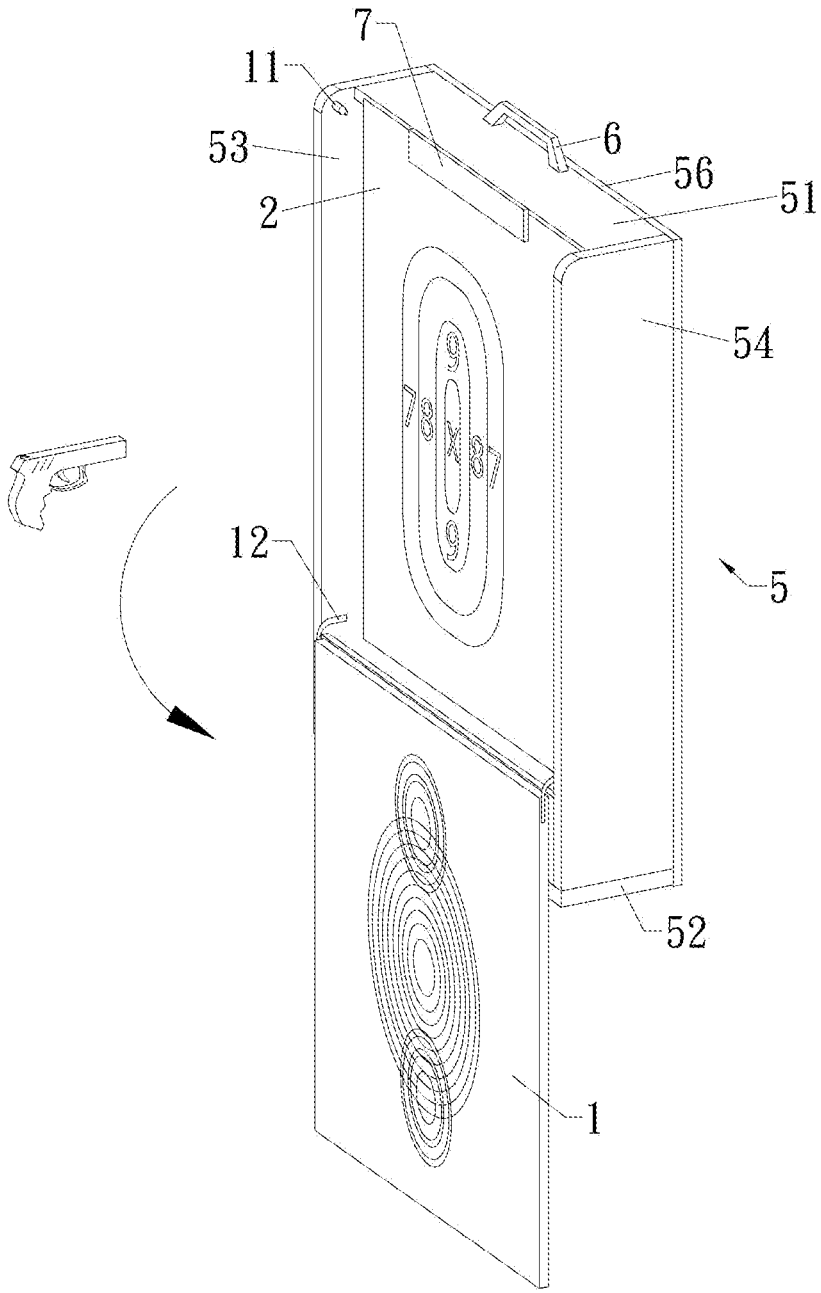
FIG. 2 is a perspective view of an embodiment shooting target of the present invention while being hung on a wall.
Figure 3:
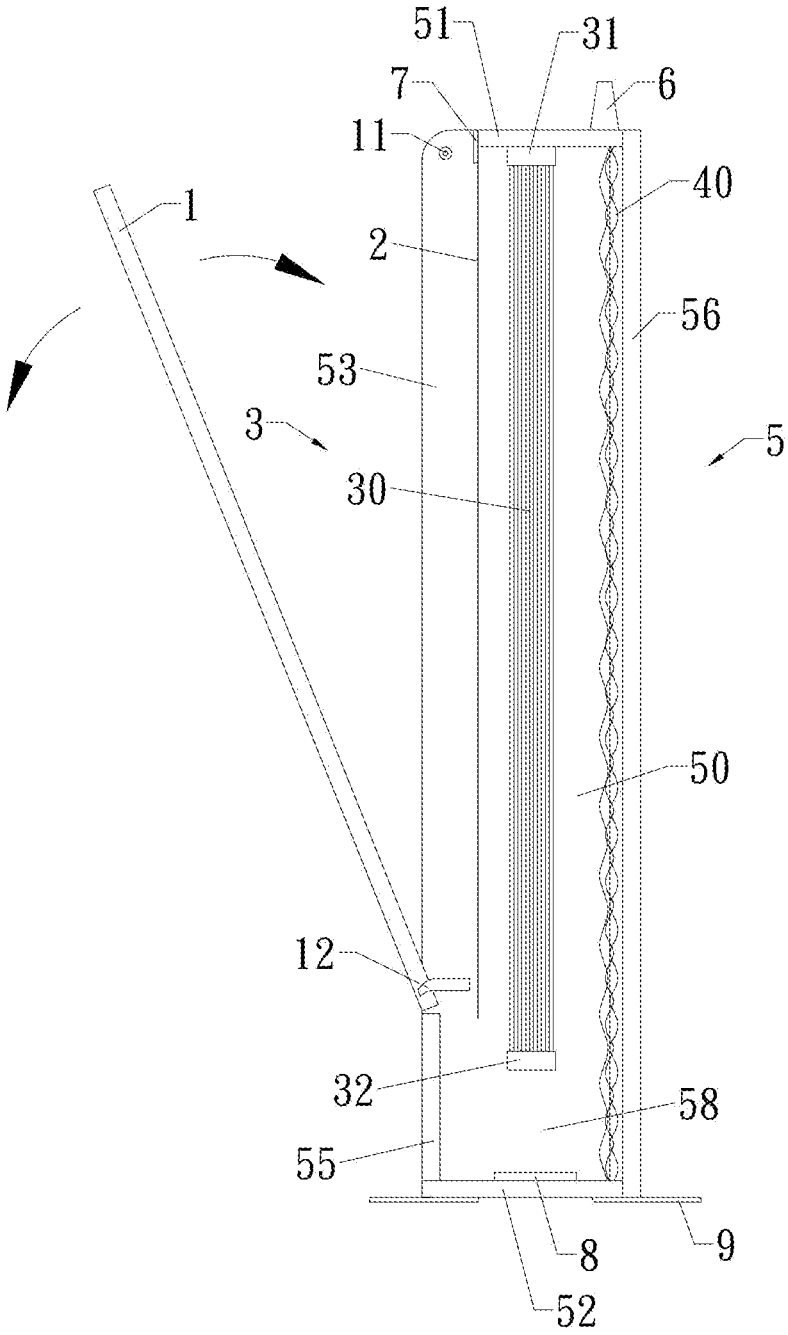
FIG. 3 is a side view of an embodiment shooting target of the present invention while standing upright.
Figure 4:
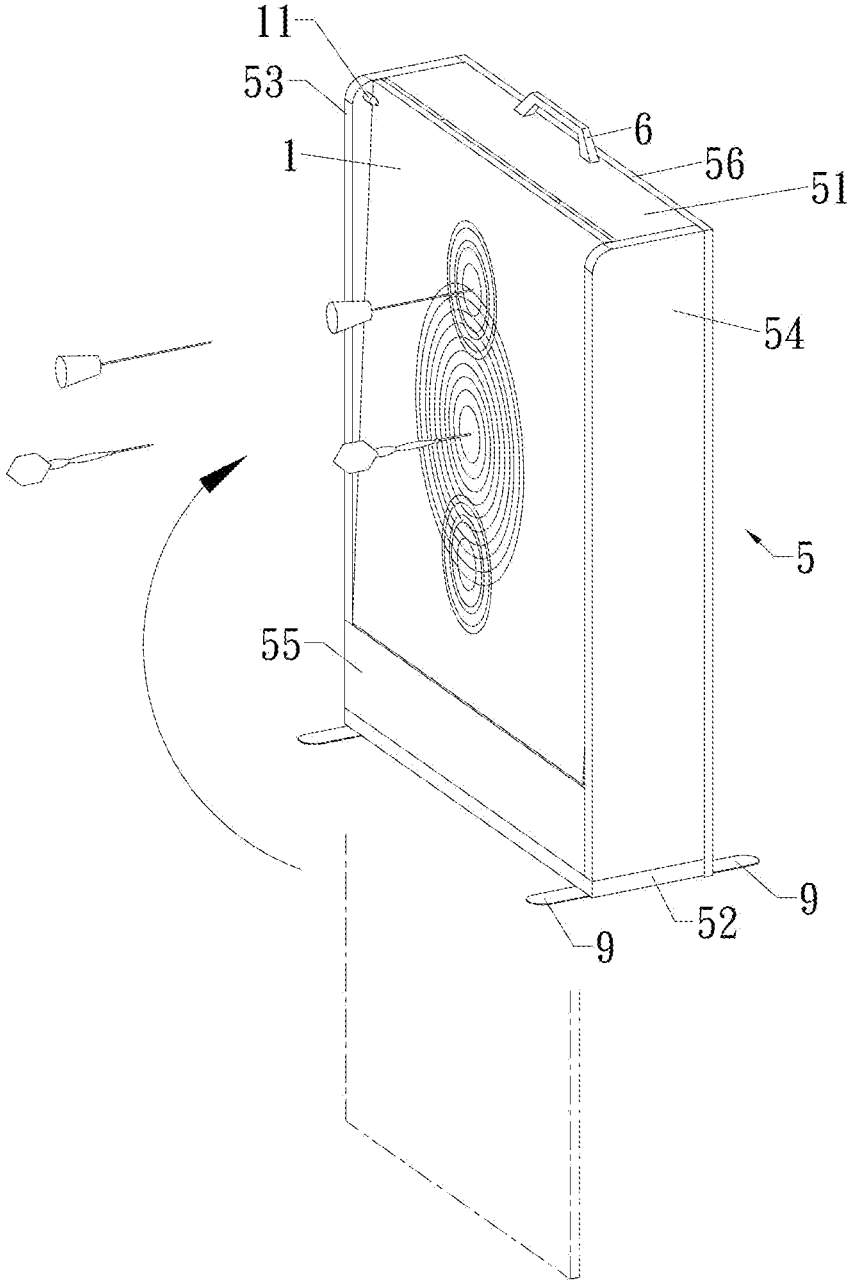
FIG. 4 is a perspective view of an embodiment shooting target standing upright according to the present invention while being used as a blowgun target and a dartboard.
Figure 5:
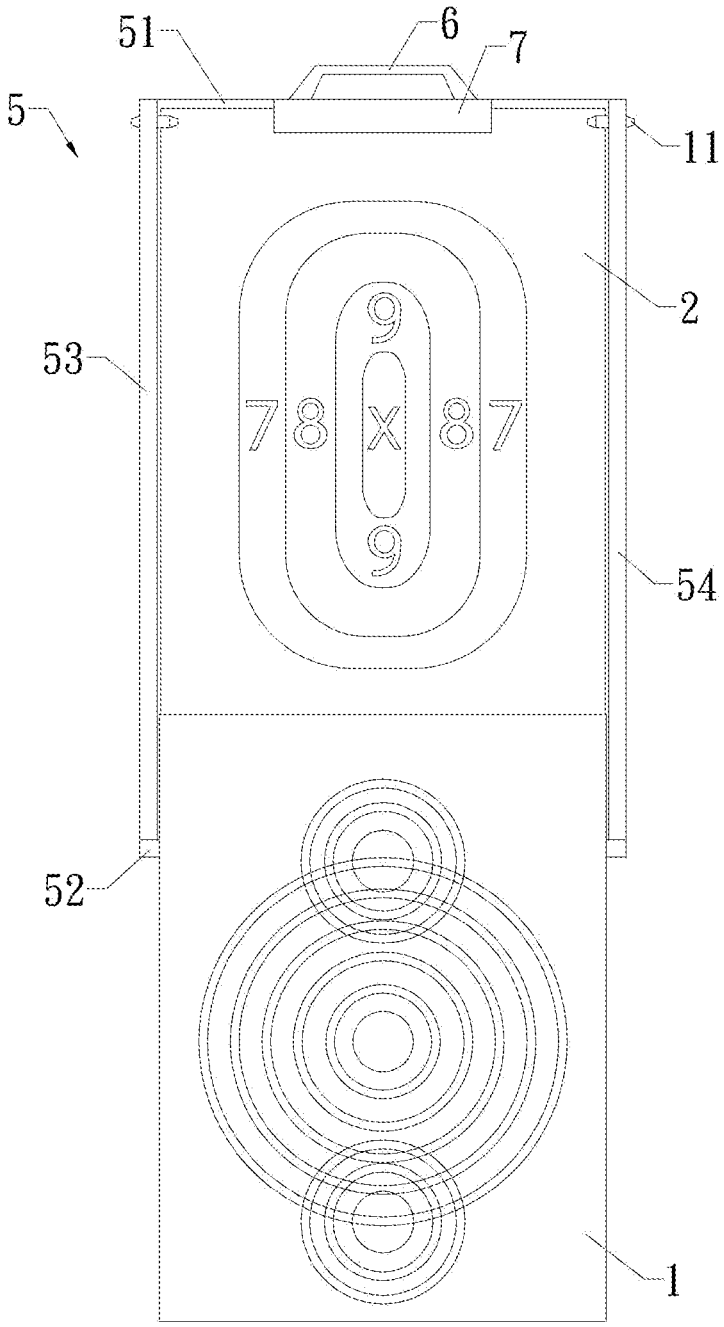
FIG. 5 is a front view of an embodiment shooting target of the present invention while being hung on a wall.

The components mentioned above are assembled to form a three-in-one indoor and outdoor shooting target. When an embodiment of the present invention is put into practice, as FIGS. 3 and 4 show, the lower side of the blowgun/darts combined double-faced target plate 1 is coupled to the lower target-plate fixing elements 12, allowing the double-faced target plate 1 to make a straight line linking the two lower target-plate fixing elements 12 to serve as a rotating axis, thereby describing a semicircular rotation of the target plate. When blowgun shooting or darts are performed, the double-faced target plate 1 is positioned upward and fixed to upper target-plate fixing elements 11 so that blowgun arrows and darts can be pulled out conveniently. Since both the front and rear faces of the blowgun/darts combined double-faced target plate 1 can be used as a shooting target, as the double-faced target plate 1 is rotated down as shown in FIG. 5, not only can it provides younger blowgun shooters with a comfortable parallel height, while toy gun shooting can be carried on simultaneously. In addition, many persons can carry out an interesting competition composed of these three shooting sports. Furthermore, the purpose of the present invention of having the projectile blocking capability, preventing the mutual collision of projectiles, the projectile stopping and collecting functions inside the toy gun target allows both low shooting speed and high shooting speed plastic projectiles to be decelerated to zero velocity in a very short distance. Referring to FIGS. 1 and 3 again, a first layer effect of projectile blocking, projectile mutual collision prevention and projectile stopping comes from the upper strip-set fixing elements 31 being engaged with the upper side of the deceleration strip set 30, the lower side of the deceleration strip set 30 being coupled to lower strip-set fixing elements 32, and the combined body being hung on the lower inner side of upper panel 51; the second layer effect of projectile blocking and projectile stopping is obtained from the impact absorber 40 that is positioned in front of the rear panel 56. When toy gun shooting is carried out, as FIGS. 2 and 3 show, the projectile speed and kinetic energy is decreased gradually while passing through the deceleration strip set 30 immediately after the projectile penetrates the target sheet 2. Furthermore, since the deceleration strip set 30 is formed by the plurality of vertically arranged strips, the projectile will be deviated from an original linear flying direction while touching one of the strips, and then the flying route is changed unceasingly and randomly in the layers of strips before the projectile leaves the deceleration strip set 30; this physical motion principle prevents linearly flying repeating projectiles spaced closely together from colliding with each other fiercely in the target to lead to the risk that the projectiles, or shattered projectiles, will fly out of the target; such types of physical application are not currently seen in conventional toy gun targets. The speeds of most low velocity projectiles will be reduced to zero, and the projectiles will drop naturally into the projectile collecting groove 58 at the lower side of the target box 5 under the resisting forces of the deceleration strip set 30. As to high velocity projectiles, they will touch the second layer deceleration device after leaving the deceleration strip set 30, and the impact absorber 40 will absorb the rest of the kinetic energy of the projectiles, causing them to drop into the projectile collecting groove 58 naturally.

Referring again to FIGS. 1 and 3, movable stabilizers 9 are installed on the lower side of the target box 5, where each stabilizer can be rotated outward to support the target box 5, thereby enlarging the center of gravity of the shooting target. In addition, the stabilizers 9 may be installed outside the target box 5. When the target box 5 is standing upright rather than hung on a wall to carry out an indoor or outdoor shooting activity, the movable stabilizers 9 are rotated to the best supporting angle to resist instabilities caused by wind speed, inclined surfaces, plastic projectiles, blowgun shooting and darts, while preventing the target box 5 from falling down, and allowing it to stand stably.

Furthermore, a projectile discharging hole 52 used for engaging with a projectile discharger 8 in an upward manner is disposed on the lower panel 52 of the target box 5. The projectile discharging hole 52 is opened or closed by rotating the projectile discharger 8, thereby conveniently and quickly letting out and recycling the projectiles collected in the projectile collecting groove 58, achieving the aim of environmental protection.

To sum up, the three-in-one indoor and outdoor shooting target of the present invention perfects the functions and safety that should be provided for a toy gun target, and the novel invention integrates a blowgun target and a dartboard, with the convenience and amusement that can be brought into full play that are otherwise hard to come by.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A multi-purpose shooting target, providing a toy gun target, a blowgun target and a dartboard in a combined structure capable of independent or simultaneous use, and comprising:

a target box, comprising a main body with an inner space, providing assembly of the following components, said inner space at a lower side of said target box comprising a projectile collecting groove, and said target box having an upper target-plate fixing element;

a double-faced target plate, providing a blowgun shooting and darts combined double-faced target plate, a lower target-plate fixing element being disposed on a lower side of said double-faced target plate and movably coupled to said target box, an upper side of said target plate being placed on the upper target-plate fixing element of said target box; and a deceleration projectile-stopping device, comprising a deceleration strip set, an upper strip-set fixing element disposed on an upper side of said deceleration strip set and coupled to an upper side of said target box, and a lower strip-set fixing element disposed on a lower side of said deceleration strip set.

2. The multi-purpose shooting target according to claim 1, wherein a projectile discharger is disposed on a bottom of said target box.

3. The multi-purpose shooting target according to claim 1, wherein a projectile discharger is disposed on both left and right sides or on front and rear sides of a lower half portion of said target box.

4. The multi-purpose shooting target according to claim 1, wherein said deceleration projectile stopping device is a deceleration strip set, disposed inside said target box, and coupled to an upper panel at said inner upper side of said target box.

5. The multi-purpose shooting target according to claim 4, wherein said deceleration projectile stopping device further comprises an impact absorber used for operating in coordination with said deceleration strip set.

6. The multi-purpose shooting target according to claim 4, wherein said deceleration strip set comprises a plurality of strips.

7. The multi-purpose shooting target according to claim 4, wherein said target box comprises an upper panel, a lower panel, a left panel, a right panel and a rear panel.

8. The multi-purpose shooting target according to claim 7, wherein a hanging hole is disposed on said rear panel.

9. The multi-purpose shooting target according to claim 7, wherein a handle is disposed on an upper side of said upper panel.

10. The multi-purpose shooting target according to claim 7, wherein a target sheet clip is disposed on a front side of said upper panel.

11. The multi-purpose shooting target according to claim 7, further comprising one or more stabilizers, movably configured on a lower side of said target box, capable of being rotated outward to enlarge the center of gravity of a shooting target.

12. The multi-purpose shooting target according to claim 11, wherein said stabilizer is configured on said lower panel at said bottom of said target box, and capable of being rotated outward to support said target box.

13. The multi-purpose shooting target according to claim 11, wherein said stabilizer is disposed outside said target box.

14. The multi-purpose shooting target according to claim 11, further comprising a target sheet clip, coupled to said upper side of said target box and used for locking a target sheet to a fixed position.

15. The multi-purpose shooting target according to claim 14, further comprising a projectile discharger, coupled to said lower side of said target box, and capable of being opened to let projectiles stored in said projectile collecting groove out.

* * * * *